United States Patent [19]

Alandy

[11] Patent Number: 4,653,778

[45] Date of Patent: Mar. 31, 1987

[54] LOCKDOWN CONNECTOR FOR MUDLINE WELLHEAD TIEBACK ADAPTOR

[75] Inventor: Jose M. Alandy, Camarillo, Calif.

[73] Assignee: Vetco Gray Inc, Ventura, Calif.

[21] Appl. No.: 745,049

[22] Filed: Jun. 17, 1985

[51] Int. Cl.[4] ..... F16L 37/12

[52] U.S. Cl. ..... 285/18; 285/39; 285/138; 285/177; 166/339

[58] Field of Search ..... 285/12, 18, 24, 39, 285/138, 140, 141, 142, 143, 177, 317, 908, 90, 81, 92; 166/339, 344, 345, 348, 360, 368; 405/169, 173, 195, 216, 170

[56] References Cited

U.S. PATENT DOCUMENTS

| | | | |
|---|---|---|---|
| 3,171,674 | 3/1965 | Bickel et al. | 285/142 |
| 3,251,611 | 5/1966 | Haeber et al. | 285/81 |
| 3,321,217 | 5/1967 | Ahlstone | 285/18 |
| 3,336,976 | 8/1967 | Word, Jr. | 166/360 |
| 3,381,983 | 5/1968 | Hanes | 285/330 |
| 3,606,393 | 9/1971 | Huntsinger | 285/90 |
| 3,827,728 | 8/1974 | Hynes | 285/90 |
| 3,837,684 | 9/1974 | Hynes | 285/142 |
| 3,890,794 | 6/1975 | Broadfoot | 405/216 |
| 3,902,743 | 9/1975 | Martin | 285/141 |

FOREIGN PATENT DOCUMENTS

| | | | |
|---|---|---|---|
| 2032561 | 5/1980 | United Kingdom | 166/348 |

*Primary Examiner*—Cornelius J. Husar
*Assistant Examiner*—Eric K. Nicholson
*Attorney, Agent, or Firm*—Joseph R. Dwyer

[57] ABSTRACT

Disclosed is a method and apparatus comprising a lockdown connector 20 which connects a subsea wellhead 74 to an outer conductor pipe 10 of the mudline suspension system 12 to convert a mudline suspension system to a subsea well system while providing adjustability in both the longitudinal and radial directions and providing a means by which loads imposed on the wellhead are transferred to the outermost conductor pipe.

5 Claims, 6 Drawing Figures

LOCKDOWN CONNECTOR FOR MUDLINE WELLHEAD TIEBACK ADAPTOR

BACKGROUND OF THE INVENTION

Related Application

The U.S. application for patent Ser. No. 745,052 entitled "Mudline Casing Hanger Tieback Adaptor With Adjustable Load Ring" filed even date herewith by Jose M. Alandy.

Field of Invention

This invention relates, in general, to subsea well systems and is directed to a method and apparatus for converting a mudline suspension system to a subsea wellhead system. More specifically, this invention is directed to a method and apparatus for placing a wellhead in a mudline suspension system and connecting this wellhead in such a manner that all loads imposed later on the wellhead in subsequent operations are transferred to the outer conductor pipe of the mudline system.

A mudline suspension system is run with a jack-up drilling vessel which is ocean bottom supported, i.e., is a stationary drilling rig. Since the rig is not moving, the outer conductor pipe strings and inner casing strings are suspended at or near the mudline and run from the mudline up to the drilling platform. Thus, the wellhead is effectively above the platform where land-type blowout preventers are installed for pressure control during drilling operations.

A subsea wellhead system is run from a floating drilling vessel which is subject to wind, waves, and heave. Thus, motion compensators, one or more ball or flexible joints, and marine riser strings are used to account for all movements of the floating vessel.

Although the two drilling operations are distinct, it is sometimes desirable to convert the mudline suspension system to a subsea wellhead system. Thus, an exploratory well drilled, using the less expensive mudline suspension system, may be converted to a production well with completion equipment, i.e., a tree connected subsea. The exploratory well may also be connected by flowlines as part of a subsea multi-well system.

In order to make this conversion, however, it is important that the subsea wellhead that is being used for the conversion be properly tied down to the mudline suspension system. This subsea wellhead is tied down to the outermost conductor pipe, as stated before, must effectively transfer loads from the wellhead to the outermost conductor pipe, and must provide adjustability in both the longitudinal and the radial directions.

It is therefore an object of this invention to provide a method and apparatus used as one of the preliminary steps in converting a mudline suspension system to a subsea wellhead system.

A more particular object of this invention is to provide a subsea wellhead and a lockdown connector which will connect the wellhead to the outermost conductor pipe while providing adjustability in both the longitudinal and radial directions in such a conversion.

More specifically, it is a further object of this invention to provide a lockdown connector which will effectively transfer load from the selected subsea wellhead to the outermost conductor pipe.

SUMMARY OF THE INVENTION

The method and apparatus which accomplishes the foregoing objects comprises a lockdown connector which connects a subsea wellhead to the outer conductor pipe of the mudline suspension system.

This lockdown connector is bell-shaped with internal threads which mate with external threads on the subsea wellhead and radial locking dogs to mate with a peripheral groove in the pin connector formed on the outer conductor pipe. This bell-shaped connector preloads in two areas to provide a more rigid connection between the subsea wellhead and the outer conductor pipe. It first preloads between the wellhead threads and the nose of the pin connector in the outer conductor pipe, and secondly preloads between the pin connector nose and the dog groove of the pin connector. Such a rigid preloaded connection is required to tolerate any eccentricity between the mudline tieback tool, the wellhead, and the outer conductor pipe, allow an adjustability in the axial direction to compensate for any stack buildup between the mudline casing hangers and the conductor pipe connector, and provide a rigid preloaded connection to resist any tensile, bending, and/or shear forces while reacting such forces on the wellhead directly to this outer conductor pipe.

Other advantages of this method and apparatus will be apparent to those skilled in the art after having studied the accompanying drawings and the following Detailed Description.

DETAILED DESCRIPTION

Figure 1:
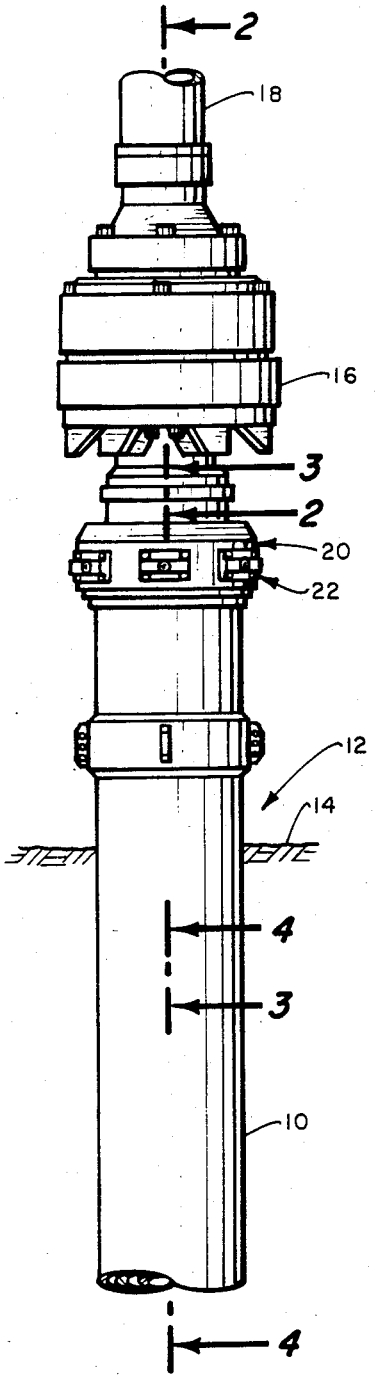
FIG. 1 is an elevational view illustrating the mudline system, the lockdown connector of this invention, and a hydraulically actuated suitable connector for connecting the mudline system to the platform for later well operations.

As shown in FIG. 1, an outer conductor pipe 10 of the mudline suspension system, indicated in its entirety as 12, located at the mudline 14, is shown with a hydraulically actuated connector 16. The latter connects the mudline system to the platform through tubing 18 after the subsea wellhead has been connected to the mudline system as part of the conversion of the mudline system to a wellhead system.

This outer conductor pipe 10 has been cemented in a previously drilled hole in the ocean floor, is conventionally a pipe 30" in diameter, and is part of the first conductor pipe run into the well bore and cemented in place. This figure also shows a lockdown connector 20 used in practicing this invention. How this latter piece of equipment is used will be described later.

The shown outer conductor pipe 10 was originally made up of several lengths of such pipe, connected together, and extending from the mudline to the platform of the stationary drilling rig.

Each conductor pipe 10 making up the string was preferably connected by a pin and box connection, such as shown in the U.S. Pat. No. 3,381,983, to Hanes, entitled "Connectable and Disconnectable Tool Joints" or the U.S. Pat. No. 3,606,393, to Huntsinger, et al., entitled "Pipe Connectors". The pin portion 22 of the connector sometimes called simply "pin 22" used in practicing this invention is shown in FIG. 3.

After the 30" outer conductor 10 is cemented in place, the standard practice is to drill smaller and deeper holes and then run additional and smaller casing strings using suitable running tools. These casing strings are conventionally suspended at the mudline and cemented in place utilizing conventional techniques. Typically, the next inner casing, after positioning the 30" outer conductor 10, is a 20" casing 24, then a third 13⅜" casing 26. Thereafter, a 9⅝" casing 30 is suspended in the conventional manner and cemented in place. At each step after cementing the outer conductor pipe 10 in place, the annular space between the casing strings are sealed and tested.

Figure 3:
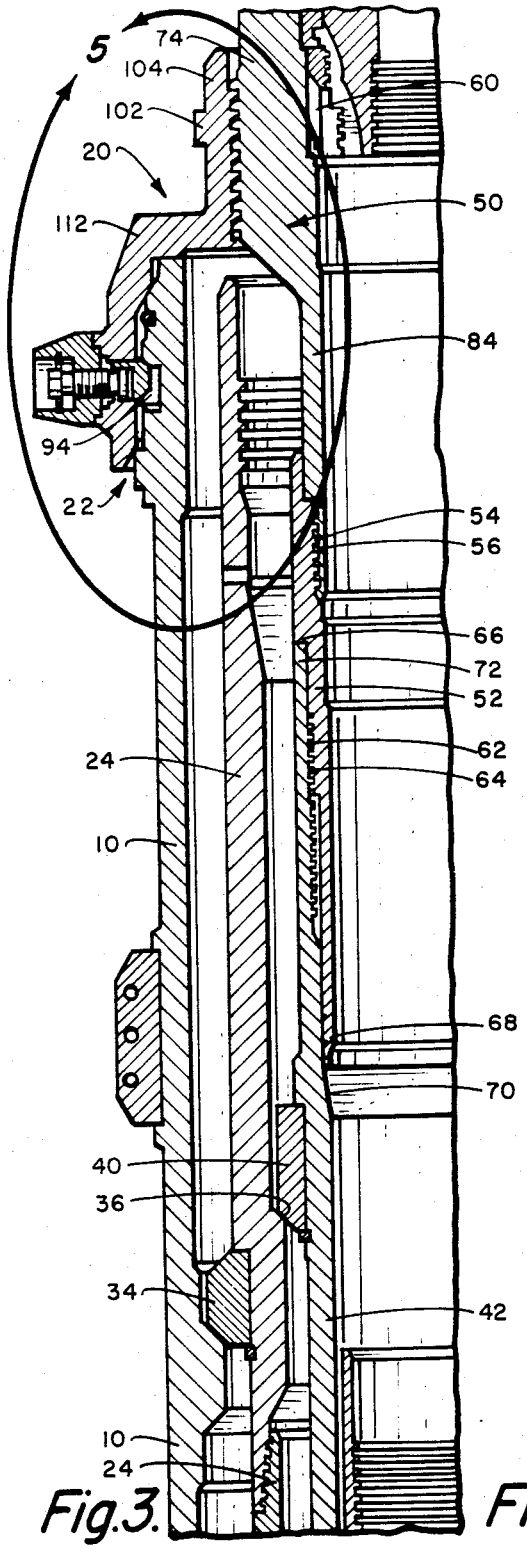
Figure 4:
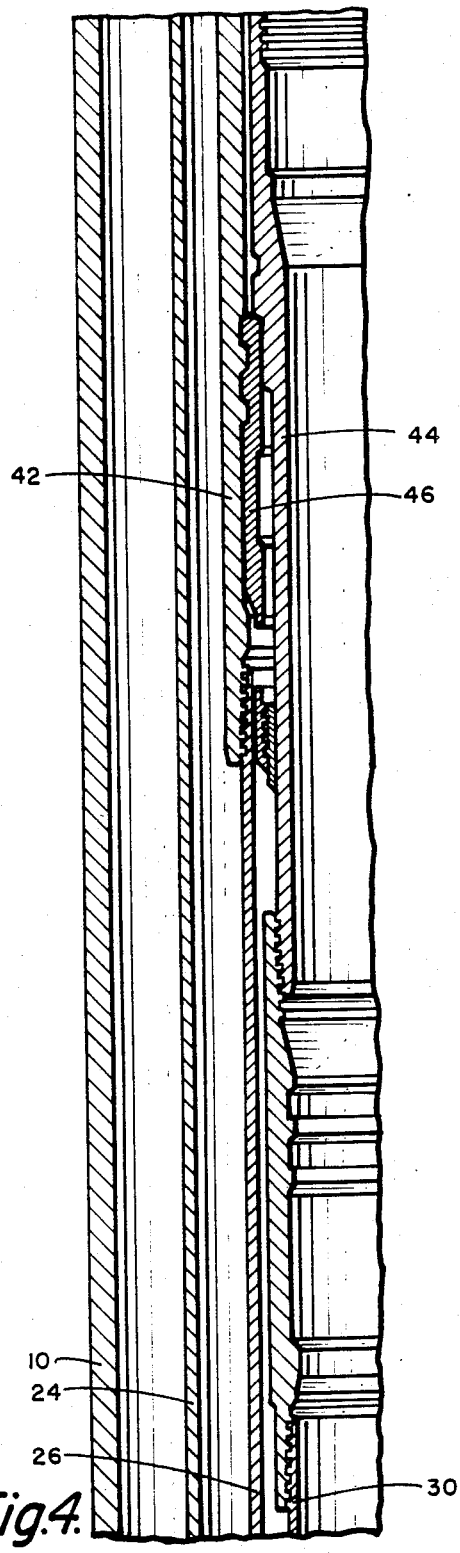

FIGS. 3 and 4 illustrate the second 20" casing 24 having landed and supported on an inner profile 32 on the outer conductor 10 by a landing ring 34, as is conventional. The 13⅝" casing 26 is also shown supported by the casing 24 on a profile 36 and landing ring 40 on a casing hanger 42, as is conventional. The next 9⅝" casing 30 is suspended on a casing hanger 44 (only partially shown) and collet 46.

Thus, all necessary casing have been run, landed, and cemented by suitable running tools to make a complete mudline suspension system. The system thus far described is conventional and well known.

When it is decided to make the conversion to the subsea well system, the corrosion cap, tools, and all inner casings above the mudline are removed leaving only that inner casings which had been cemented in place at the mudline. The outer conductor string made up of the segments of conductor pipe 10, remain intact.

The next step is to run the mudline wellhead adaptor 50, sometimes called simply "wellhead 50" and a tieback tool 52 on a running tool, connected to drill pipe, through the string of conductor pipes 10 to the 13⅜" casing hanger 42 and to thread the tool onto the casing hanger 42 and to test the seal therebetween. The wellhead adaptor has external threads 54 on its lower end which engage internal threads 56 on the top of the tieback tool, when the two are connected together to be lowered by the running tool. The wellhead adaptor has J-slots 60 shown in FIGS. 2, 3 and 5 for attachment to the running tool.

The tieback tool 52 is a sleeve which will connect wellhead adaptor 50 to the 13⅜" casing hanger 42 and, in addition to threads 56, is provided with external threads 62 midway thereof for mating with internal threads 64 below the top 66 or mouth of the 13⅜" casing hanger 42. The tieback tool is provided with a metal-to-metal seal assembly 68 which engages a tapered surface 70 on the inner periphery of the 13⅜" casing hanger 42, and when the tieback tool 52 has landed and is threaded onto the casing, the tieback tool 52 will be shouldered as at 72 on the top of the casing hanger 42 and the metal-to-metal seal will be made up. In this position, the integrity of the seal assembly 68 is tested.

Figure 2:
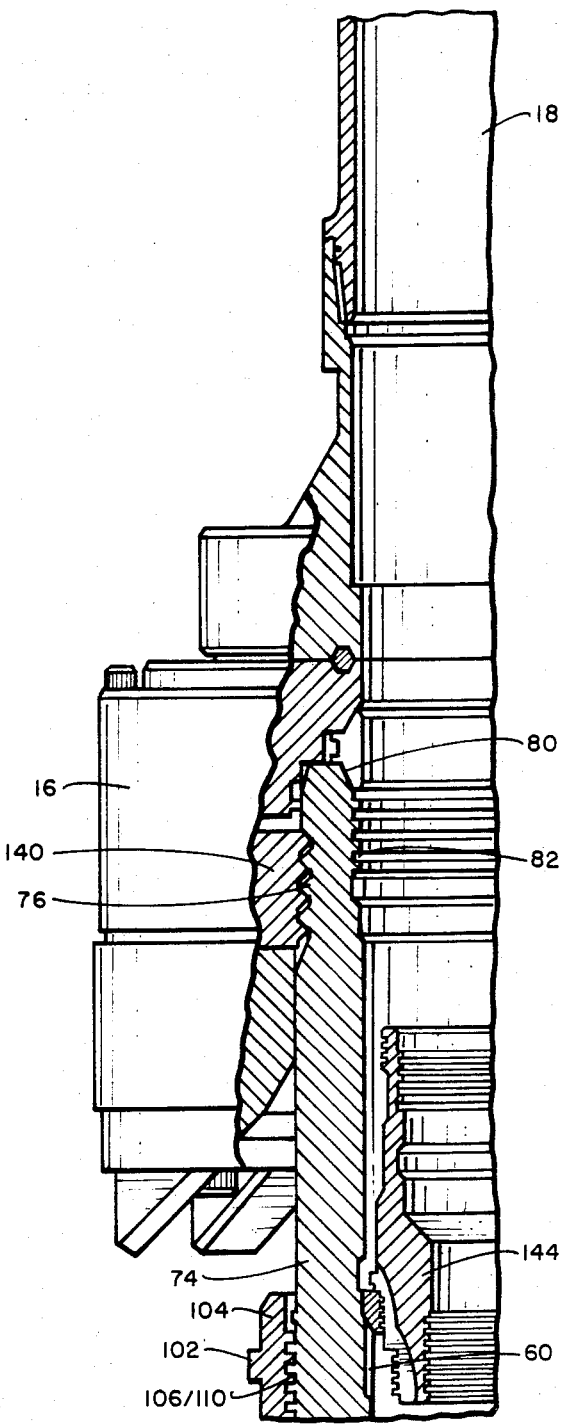
FIG. 2 is an enlarged cross-sectional view taken along line 2—2 of FIG. 1, FIG. 3, taken along line 3—3 of FIG. 1 incorporates the lower part of FIG. 2 and illustrates the lockdown connector connected between the wellhead and the outermost conductor pipe, FIG. 4, taken along line 4—4 of FIG. 1 is an extension of FIG. 3 to illustrate details of the wellhead system.

This wellhead adaptor 50 is conventional in shape in its main upper body portion 74, that is, it is provided with a profile 76 on the outer periphery thereof, for connection to the connector 16 as shown in FIG. 2. The profile is a series of grooves formed a short distance below the top 80 or nose of the wellhead. The wellhead is further provided with internal threads 82 for tieback and running tools on its inner bore. For this system, however, the main body portion 74 is provided a downward thinner extension 84 formed by reducing the outer diameter of the wellhead. This latter extension 84 has the external threads 54 by which it is connected to internal threads 56 on the top of the tieback tool, as shown in FIG. 3.

The next step in the conversion is to disconnect all of the conductor pipes 10 of the string above the mudline, leaving only the pin connection 22 as mentioned above.

The split lock ring in groove 94 is removed from the pin 22 to allow the lockdown connector 20 to be used. This split lock ring, though not shown in the drawings, corresponds to the lock ring 22 in the Hanes Patent and the lock ring 28 in the Huntsinger, et al. Patent, supra.

Removal of the split lock ring from groove 94 prepares the pin 22 to receive the lockdown connector 20, and the next step is to connect the lockdown connector 20 to a suitable running tool 96. Since the running tool 96 is the convention type with J-slots 100 to receive the lugs 102 on the outer periphery of the tubular portion 104 of the lockdown connector, it is shown only in phantom.

Figure 5:
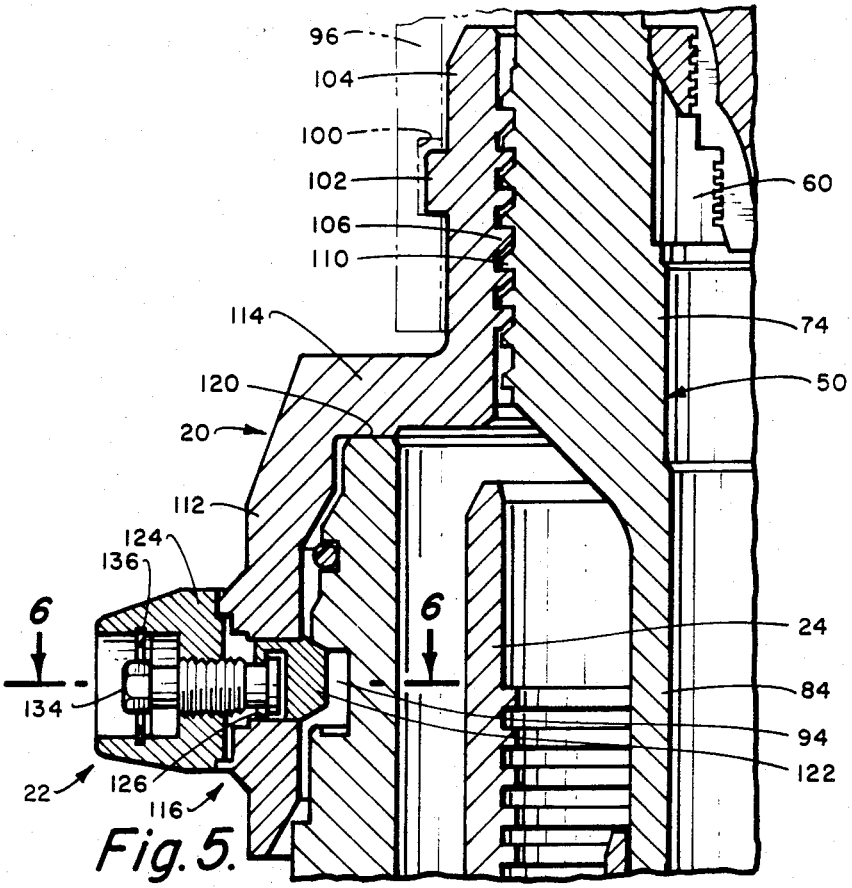
FIG. 5 is an enlargement of the area, defined by the arrow 5, in FIG. 3 to illustrate the lockdown connector in more detail.

More specifically, as can be seen in FIGS. 3 and 5, the lockdown connector 20 is a bell-shaped body having the upwardly extending tubular portion 104, which is internally threaded at 106 to engage external threads 110 on the main body portion 74 of the wellhead. The threads are modified square threads. Between the tubular portion 104 and a downwardly extending wall or skirt 112 is a radially outwardly extending wall 114 which, with the tubular portion 104 and downwardly extending wall 112, form the bell shape. As shown in FIG. 5, the downwardly extending wall 112 and the thinner extension 84 of the wellhead span the pin connection 22 and the inner bore of the 13⅜" casing hanger 42. The lugs 102 are, of course, located on the outer periphery of the tubular portion 104, as shown.

The lockdown connector is also provided with a plurality of bolt/dog assemblies 116 which will effectively connect the wellhead 50 to the outer conductor pipe 10 when the lockdown connector 20 is lowered onto the wellhead housing and the pin 22, of conductor pipe 10 as will now be explained.

As mentioned above, it is important that the lockdown connector not only connect to the selected subsea wellhead 50 and to the conductor pipe 10, but provide adjustability in both longitudinal and radial directions and effectively transfer load from the wellhead 50 to the conductor pipe 10.

To do this, the lockdown connector is first rotated by the running tool and threaded onto the threads 110 on the wellhead so that the inner surface of the radially extending wall 114 will engage the top 120 or nose of the pin 22. This provides a preload between the top of conductor pipe 10 and the threads 110 on the wellhead. Thereafter, the bolt/dog assemblies 112 are actuated to urge dogs 122 into the groove 94 to tightly engage the groove 94. This preloads the pin 22 and the lockdown connector 20 in the groove 94.

Figure 6:
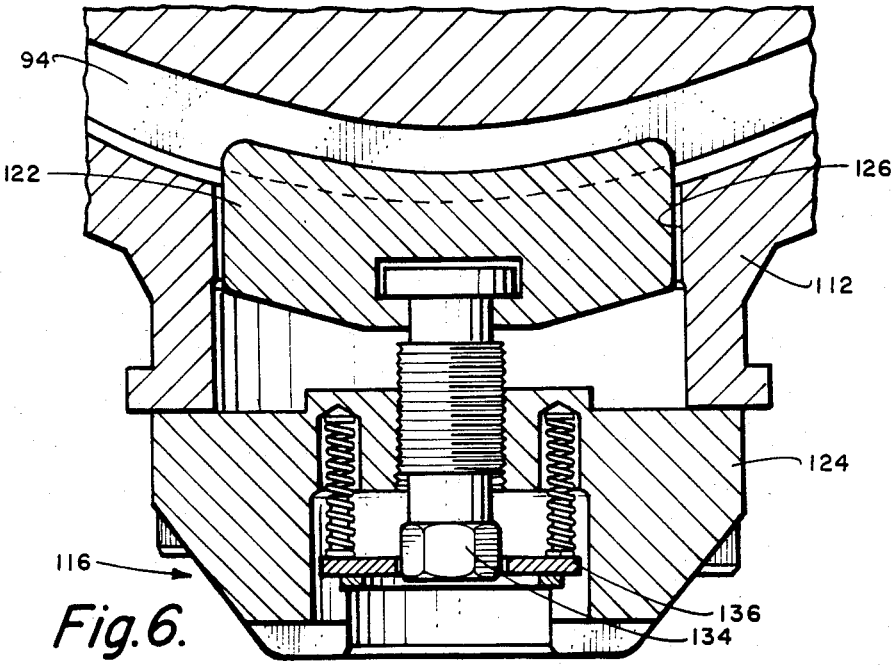
FIG. 6 is an enlarged cross-sectional view taken along line 6—6 of FIG. 5 to illustrate the details of the locking dog assembly of the hydraulically actuated connector.

FIG. 6 illustrates in detail one of the bolt/dog assemblies 116 which comprises essentially a head or boss 124 bolted onto the downwardly extending wall 104 which positions the dog 122 in an aperture 126 in wall 112 and into the groove 94. The actuator for urging the dog 122 comprises a threaded actuator screw 126 threaded in the boss 124, coupled to the dog 122, and actuated by a wrench on hexagonal head 134. To prevent backoff of the dog 122, a suitable spring actuated lock plate 136 engages the hexagonal head. This assembly is similar to the actuator devices 40 described and shown in the Huntsinger, et al. Patent, supra, to which reference is made if further information about this type of assembly is required.

Finally, to connect the now partially converted mudline suspension system to a platform, the hydraulically actuated connector 16 is lowered via tubing 18 and connected to the wellhead 50. This connector includes hydraulically actuated dogs 140 which engage the profile of 76 on the upper end of the wellhead 50 and essentially locks the wellhead to the tubing 18. This connector 16 is disclosed and claimed in the U.S. Pat. No. 3,321,217 to Ahlstone, to which reference is made if further details are thought necessary. This is a well-known connector used extensively in subsea systems.

Later, a casing hanger 144 of the conventional type may be landed in the conventional way within the wellhead 50.

From the foregoing, it can be seen that there is disclosed a method and apparatus by which a mudline suspension system can be converted into a subsea well system through the use of a connector and a subsea wellhead and a lockdown connector. This lockdown connector performs the necessary function to the conversion by preloading in two areas to provide a more rigid connection between the modified wellhead and the outer conductor pipe to essentially transfer all loads imposed on the wellhead to the outer conductor pipe for later wellhead operations.

I claim:

1. A lockdown connector for transferring loads from a subsea wellhead to an outer conductor pipe of a mudline suspension system comprising:

a bell-shaped body having internal threads for engaging external threads on the wellhead;

means on said connector for engaging a running tool for rotating said connector to thread said bell-shaped connector onto said wellhead and to engage a mouth of said outer conductor pipe, and means on said connector for engaging a groove on the outer periphery of said outer conductor pipe.

2. The connector as claimed in claim 1 wherein said means for engaging a running tool comprises lugs on said connector for cooperating with corresponding J-slots on said running tool.

3. The connector as claimed in claim 2 wherein means for engaging a groove comprises a bolt/dog assembly which includes a dog engageable in said groove and an actuator screw for urging said dog into said groove.

4. A means for converting a mudline suspension system to a subsea wellhead system, said mudline suspension system having a plurality of concentric casings to the water surface, and said means comprising;

a tieback tool for engaging one of said casings in sealing relationship therewith;

a wellhead connected and lowered with said tieback tool;

said wellhead having external threads thereon;

a lockdown connector threadably engaging the threads on said wellhead and torqued to engage the top of the outermost of said concentric casings, and means for engaging the outermost of said concentric casings to lock said connector and wellhead to said outermost casing and engaging said casing in such a way that any load opposed on said wellhead are transferred to said outermost conductor.

5. A method of converting a mudline suspension to a subsea wellhead system, said mudline suspension system having a plurality of casings suspended within an outer conductor pipe by casing hangers and tieback tools;

the method including the steps of;

removing all casing within said outer conductor pipe, except those below the mudline;

running and setting a wellhead and tieback tool;

connecting said tieback tool to one of said casing;

running and connecting a lockdown connector to said wellhead and preloading said lockdown connector against a top of said outer conductor pipe, and radially locking said lockdown connector to said outer conductor pipe so that said lockdown connector is preloaded axially and radially to said outermost conductor pipe.

* * * * *